US005145398A

United States Patent [19]

Manabe

[11] Patent Number: 5,145,398

[45] Date of Patent: Sep. 8, 1992

[54] TURNING INSERTION TYPE ELECTRICAL CONNECTOR SYSTEM

[75] Inventor: Sakae Manabe, Kawasaki, Japan

[73] Assignee: AMP Incorporated, Harrisburg, Pa.

[21] Appl. No.: 726,134

[22] Filed: Jul. 3, 1991

Related U.S. Application Data

[63] Continuation of Ser. No. 578,988, Sep. 6, 1990, abandoned.

[30] Foreign Application Priority Data

Sep. 6, 1989 [JP] Japan ..... 1-230851

[51] Int. Cl.[5] ..... H01R 4/50

[52] U.S. Cl. ..... 439/341; 439/676

[58] Field of Search ..... 439/11, 13, 31, 326, 439/328, 372, 374, 376, 378, 676

[56] References Cited

U.S. PATENT DOCUMENTS 3,171,704 3/1965 Meile ..... 439/341
4,715,819 12/1987 Iwasa et al. ..... 439/31
4,863,387 9/1989 Snaper et al. ..... 439/31
4,877,409 10/1989 Tanigawa et al. ..... 439/31
4,941,837 7/1990 Nakamura ..... 439/341

FOREIGN PATENT DOCUMENTS 0119951 9/1984 European Pat. Off. ..... 439/341

*Primary Examiner*—David Pirlot
*Attorney, Agent, or Firm*—Allan B. Osborne; Adrian J. LaRue

[57] ABSTRACT

A turning insertion type electrical connector system is disclosed. The system includes a receptacle side connector (20) which mates to a plug side connector (40) by a turning motion. The receptacle side connector (20) includes recesses (23) which are arc-shaped in cross section and which receive arc-shaped protrusions (43) when the connectors (20,40) are mated. Further a projection (24) on one connector (20) has multiple protrusions (24') which lock into holes (44') on a projection part (44) on the second connector (40).

8 Claims, 6 Drawing Sheets

TURNING INSERTION TYPE ELECTRICAL CONNECTOR SYSTEM

This application is a continuation of application Ser. No. 07/578,988 filed Sep. 6, 1990, now abandoned.

FIELD OF THE INVENTION

The present refers to an electrical connector system and in particular to a type of electrical connector system which can be mated by turning.

BACKGROUND OF THE INVENTION

In recent years, there has been a great deal of progress in the manufacture of electrical devices which are smaller and have greater performance than the conventional one. There has correspondingly been a demand for hard disks which can easily be attached and detached in laptop personal computers. In order to make the hard disk easily attachable and detachable in the body of the personal computer, a hard disk drive (HDD) should be able to be installed or mounted in the body so that it can easily be attached and detached. However, the following problems arose when the hard disk drive was installed mechanically and electrically.

In order to couple a hard disk drive to the body (of the PC) mechanically, a connector is placed (a) on the front insertion end of a hard disk drive and (b) on the side of the body which this front end touches when the hard disk drive is inserted and coupled so that it rubs and makes contact horizontally against a notched part which is located on the lower side of the body. There were a number of problems which arose when this type of brushing contact and fitting type was used. When the connector started to make contact, the insertion resistance increased when the hard disk drive was inserted so that it could be coupled and fought this resistance when the hard disk drive was pressed in. A great mechanical impact occurred when the insertion was completed, that is to say, when the hard disk drive and the body made contact with each other. This imparted a mechanical impact to the hard disk drive, which was undesirable for the hard disk drive (which is a precision machine).

It is an object of the present invention to take these problems into consideration and provide an electrical connector system which is suitable for these applications and which can be easily attached and detached with a minimum of shock.

SUMMARY OF THE INVENTION

According to the invention a turning insertion type electrical connector system is provided which includes a receptacle side connector and a mating plug side connector. The receptacle side connector is provided with a recess which is arc-shaped in cross section for receiving a complementary shaped protrusion on the plug side connector when the two connectors are mated.

DESCRIPTION OF THE INVENTION

Figure 1:
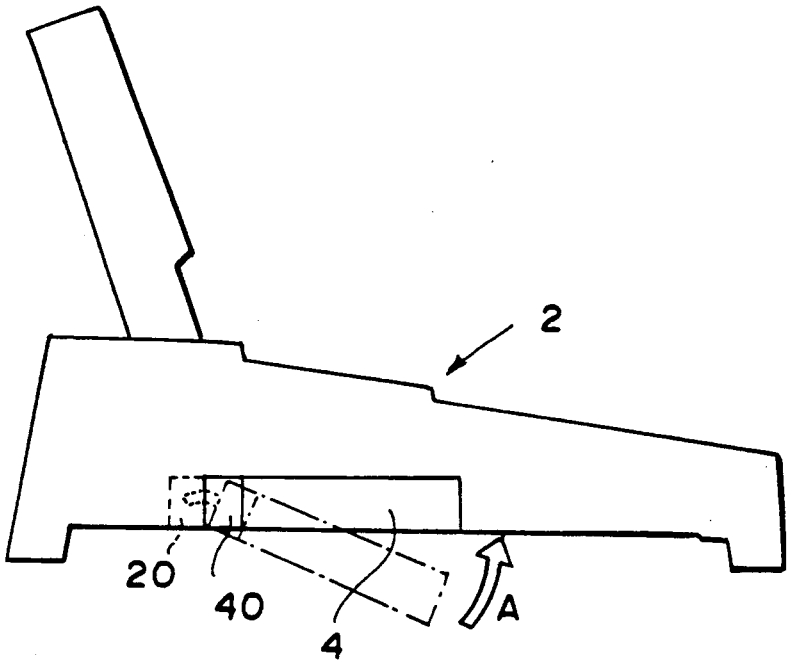
FIG. 1 is an explanatory side view of an example which uses the connector in the present invention to facilitate attaching and detaching of the hard disk drive to a laptop personal computer.

As FIG. 1 indicates, the connector in the present invention is used to install hard disk drive 4 in the bottom part of laptop computer body 2 so that it can be attached and detached easily.

Figure 2:
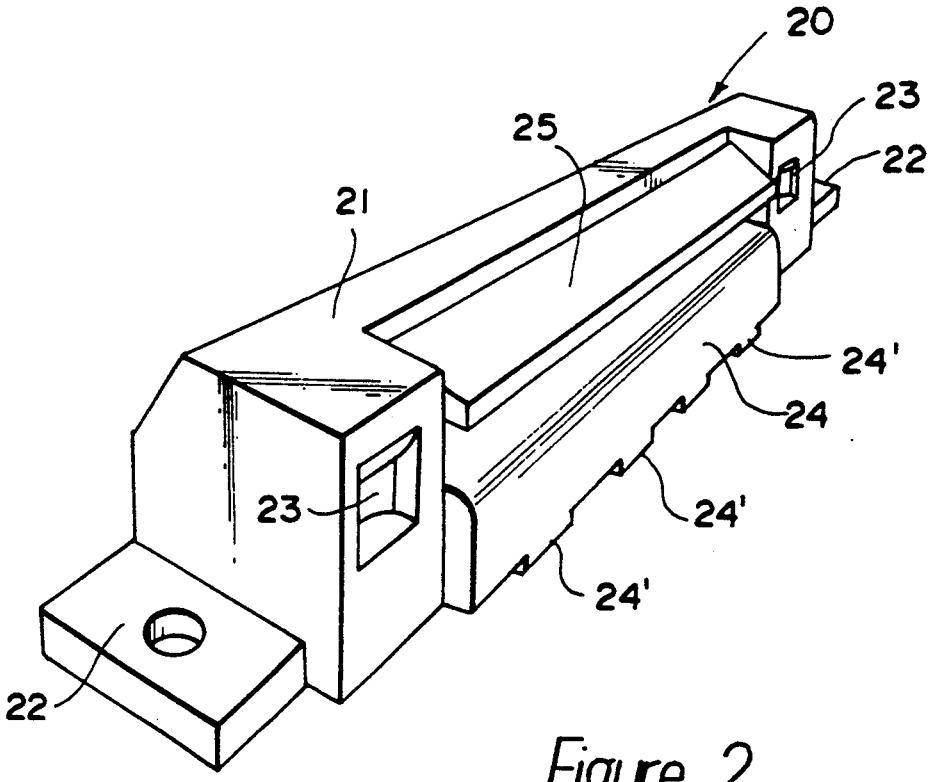
FIG. 2 is an inclined view of the receptacle connector in the connector based on a practical example of the present invention.
Figure 3:
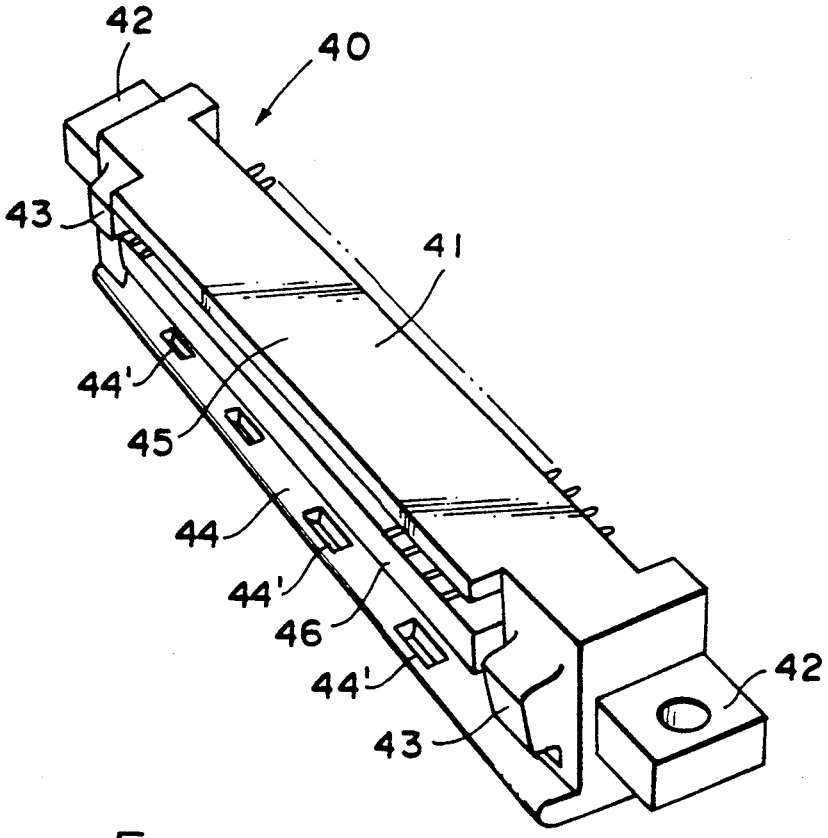
FIG. 3 is an inclined view of the plug connector.

In FIG. 2, receptacle side connector 20 is fixed to personal computer body 2 In FIG. 3, plug side connector 40 is fixed to hard disk drive 4. When hard disk drive 4 is installed in personal computer body 2, the end part of the side of connector 40 of hard disk drive 4 is brought into contact with connector 20. The lower edge part of the surface which makes contact with the connector as indicated by arrow A in FIG. 1 is used as a support point and hard disk drive 4 is installed by turning it from the position indicated by the dotted line to the position indicated by the continuous line. Connector 20 on the receptacle side (hereafter referred to as "receptacle") is equipped with ear parts 22 and 22 which are fixed to both ends of housing 21 and to personal computer body 2, as indicated in FIG. 2. It is equipped with recessed parts 23 and 23 (which are arc-shaped when seen in cross-section) on both ends of the front surface (the side which faces plug side connector 40). The lower front side is provided with a projection part 24 which is equipped with multiple protrusions 24' for the interlocking which forms support points on the bottom. Housing 21 is provided with shelf or ledge part 25 which is located on the upper part of the front surface at an interval from the projection part 24. Housing 21 is equipped with multiple electric contacts 27 (please refer to FIG. 4 and FIG. 5) on the upper part of space 26 which is formed between this shelf part 25 and the projection part 24.

Plug side connector 40 (hereafter, referred to simply as "plug connector") is equipped with ear parts 42 and 42 which are used for fixing to the hard disk drive 4 on both sides of the housing 41 as indicated in FIG. 3. It is provided with protrusions 43 and 43 which are arc-shaped when seen in cross-section on both ends of the front (the side which faces receptacle connector 20). It is provided with projection part 44 which extends to the lower part of the front surface in the width direction, receives the protrusion 24 used for interlocking with the receptacle connector 20 on the upper surface and which is equipped with multiple holes 44' which interlock with this. It is provided with a cover part 45 which extends in the width direction and fits onto the top of the above-mentioned shelf part 25 when it is coupled with the receptacle connector 20 on the upper part of the front surface. It is provided with projection part 46 which extends in the width direction and fits into the space 26 in the center of the receptacle connection mentioned previously in the middle of the front surface. It is equipped with multiple electric contacts 47 (please refer to FIG. 4 and FIG. 5) which are connected electrically with the above-mentioned electric contacts 27 on the receptacle connector 20 on the upper surface of projection part 46 in the middle.

Figure 4:
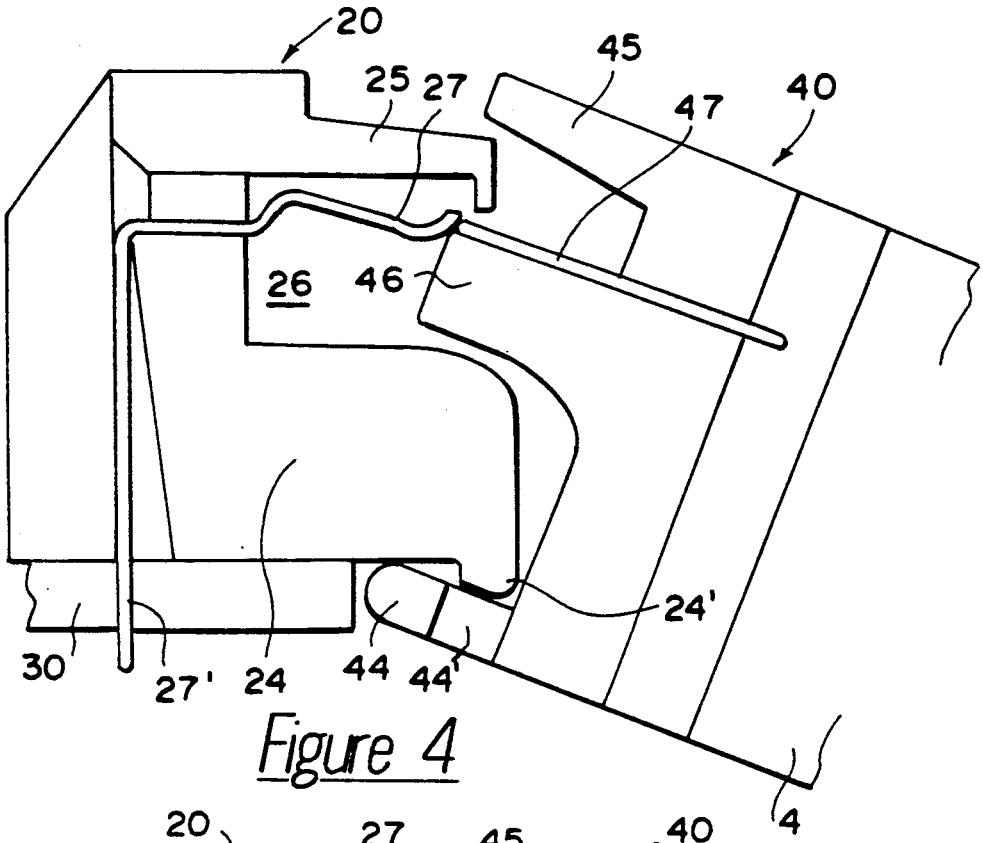
FIG. 4 is central cross-section of both connectors right before they are coupled.
Figure 5:
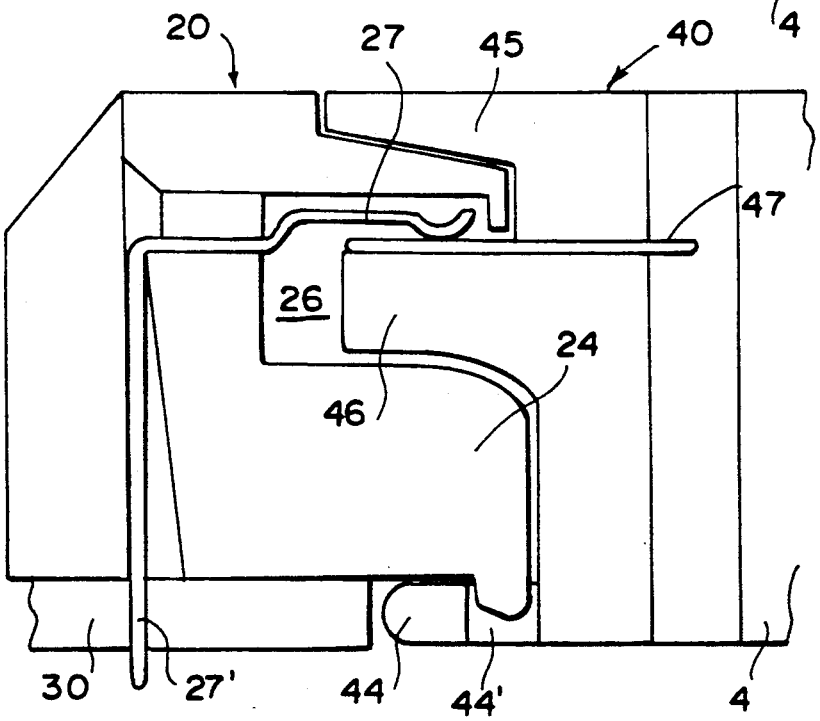
FIG. 5 is a central cross-section of the connectors when they are coupled.
Figure 6:
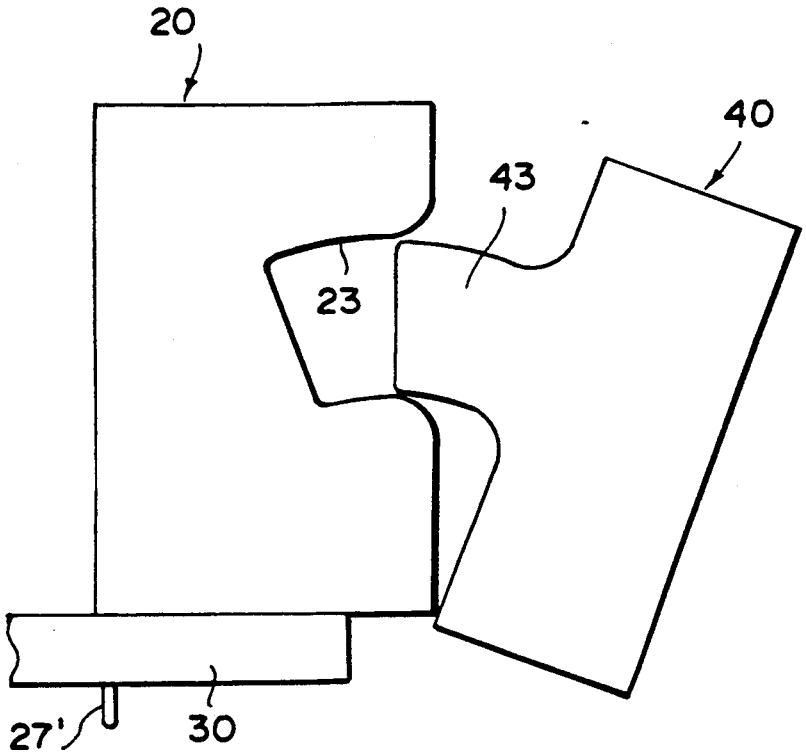
FIG. 6 is a cross-section of the end parts right before the connectors are coupled.
Figure 7:
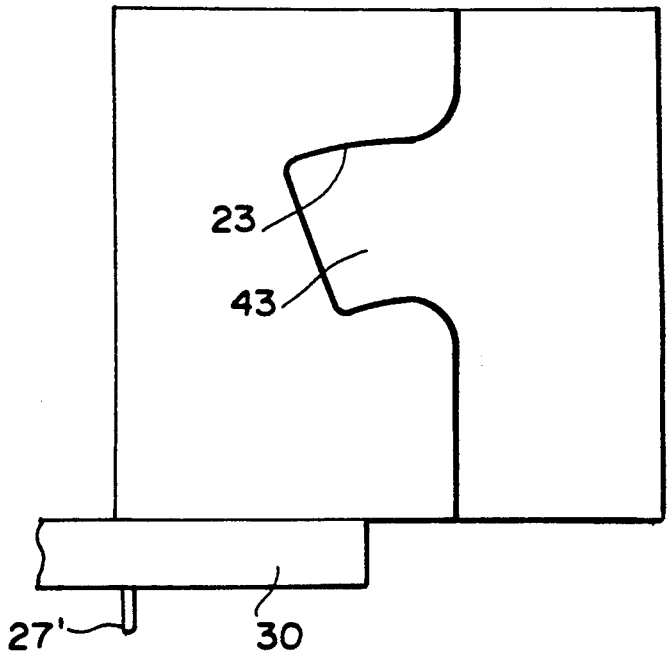
FIG. 7 is a cross-section of the end parts when the connectors are coupled.
Figure 8:
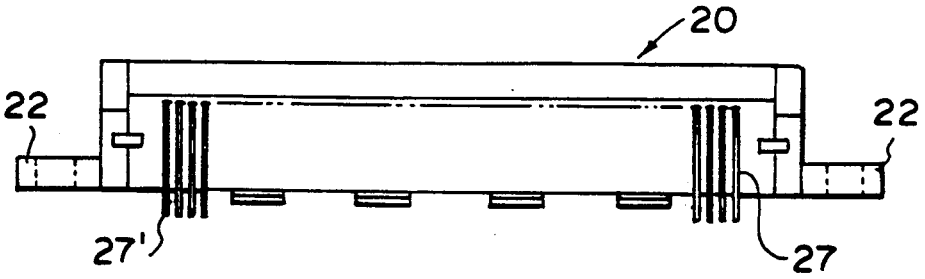
FIGS. 8 through 11 are respectively a rear view, a plane view, a frontal view and a side view of the above-mentioned receptacle connector.
Figure 9:
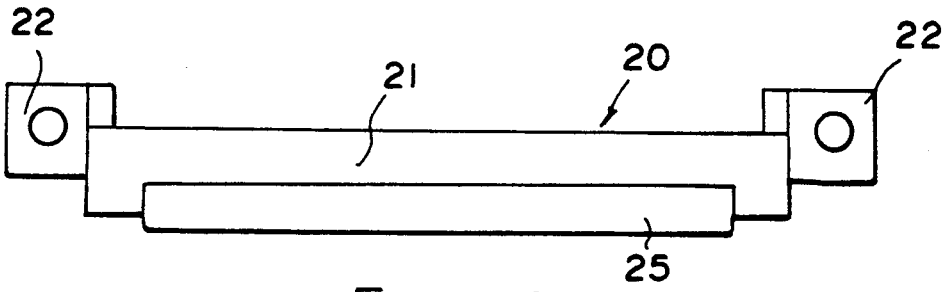
Figure 10:
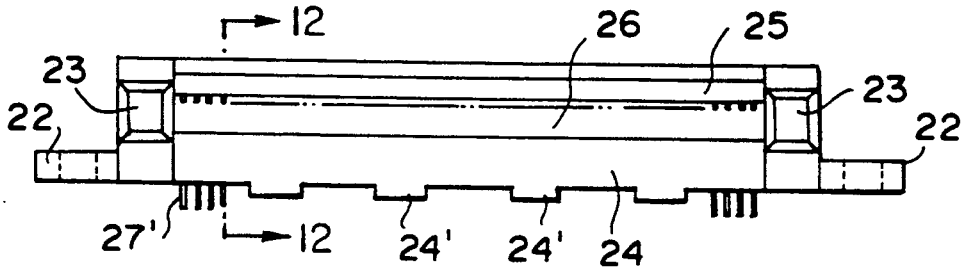
Figure 11:
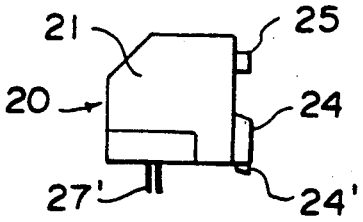

FIG. 4 and FIG. 5 are cross-sections of the center parts of connectors 20 and 40 (the part for electric contacts 27 and 47). FIG. 6 and FIG. 7 are cross-sections of the end part (the part for recessed arc-shaped part 23 and protrusion 43). (Hatching for each cross-section has been omitted).

FIG. 4 and FIG. 6 show the device just before it is mounted. FIG. 5 and FIG. 7 show the device after being mounted.

As FIG. 4 indicates, electric contacts 27 of receptacle connector 20 pass through the printed circuit board (PCB) 30 on the side of computer mainframe which has been fixed to the lower surface of receptacle connector 20. It is provided with tine part 27' which has been soldered to this and is fixed to receptacle connector 20 using a commonly known method Electric contacts 47 of the plug connector 40 are connected electrically to the circuit board (not shown in figure) of the side of hard disk drive 4 and is fixed to plug connector 40.

When hard disk drive 4 is mounted onto the PC mainframe 2, the front end of hard disk drive 4 (the end part on which plug connector 40 is placed) is brought into contact on an incline with the end part (the side on which the receptacle connector 20 is placed) of the concave part used for mounting the hard disk drive on the lower surface of PC mainframe 2, as indicated in FIG. 1. Protrusions 24' on projection part 24 on the lower part of receptacle connector 20 extend into holes 44' on projection part 44 on the lower part of plug connector 40. The top edge of projection part 44 on the lower part of this plug connector 40 is used as a support point and hard disk drive 4 is turned to the position indicated in FIG. 5.

At this time, arc-shaped protrusions 43 and 43 on plug connector 40 are guided into arc-shaped recessed parts 23 and 23 on the receptacle connector 20 and are fitted in and the turning motion is guided centering on the above-mentioned support point, as indicated in FIG. 7. At this time, when the support point interlocking system is configured by interlocking the convex part (protrusions 24') on receptacle connector 20 into the concave part (holes 44') of the plug connector, the force applied is nearly zero and the center (support point) of the turning is determined by just inserting. Arc-shaped protrusion 43 and the recessed parts 23 on both sides of the connector become a guide for turning so that the connector can be attached and detached quite easily and smoothly. Since this is a turning and fitting operation rather than a brushing contact and fitting operation, there is no shock to the hard disk drive and other electrical mounted parts.

When hard disk drive 4 (which is an electrical mounting part connected to plug connector 40) is held and fitted in instead of fitting together both connectors by holding plug connector 40 in the hand, the distance from the support point to the dynamic point (the part which grips hard disk drive 4) is longer than the distance from the support point (turning center) to the operational point (contact point for electric contacts 27 and 47). The force required for fitting using the lever principle can be reduced and used for reliable electrical connection using sufficient contact pressure.

In addition, both connectors are guided when fitted together by arc-shaped protrusion 43 used for guiding and by recessed parts 23. At the same time, the protrusion and the recessed part are coupled after fitting so that both connectors can be prevented from falling apart in the arc-shaped radius direction (the up and down direction on the side of the diagram) of these [the protrusion and the recessed parts]. The electrical mounting part (hard disk drive 4) is retained for the electrical device (computer mainframe 2) after fitting together and can withstand that retaining force sufficiently even when the electrical mounting part is heavy.

The force required for turning and fitting together can be adjusted by changing the dimensions of arc-shaped protrusion 43 and recessed parts 23. This means that the closer the dimensions of these two parts is, the greater the force required to turn and fit together. The more disparate the dimensions of these two parts are, the less force required to fit together.

The concave part and the convex parts which have an arc-shaped surface as mentioned previously need by no means be placed on both ends of the housing and may be placed between adjoining electric contact points 27 and 47.

Figure 12:
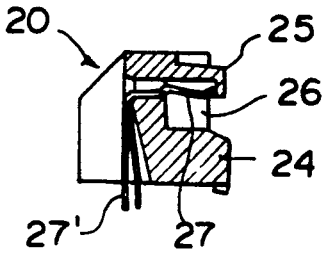
FIG. 12 is a cross-section along lines XII—XII of FIG. 10.
Figure 13:
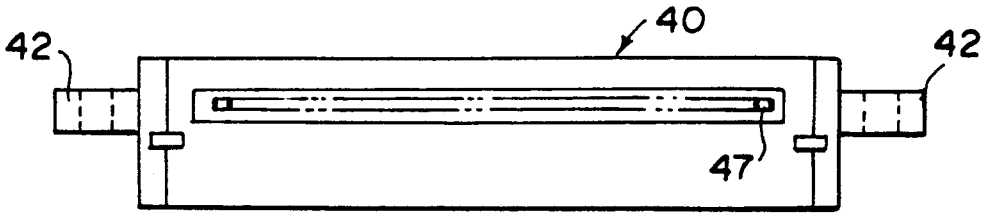
FIGS. 13 through 16 are respectively a rear view, a plane view, a frontal view and a side view of the above-mentioned connector.
Figure 14:
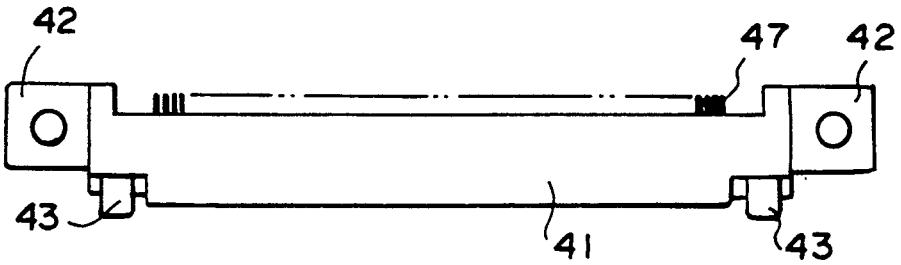
Figure 15:
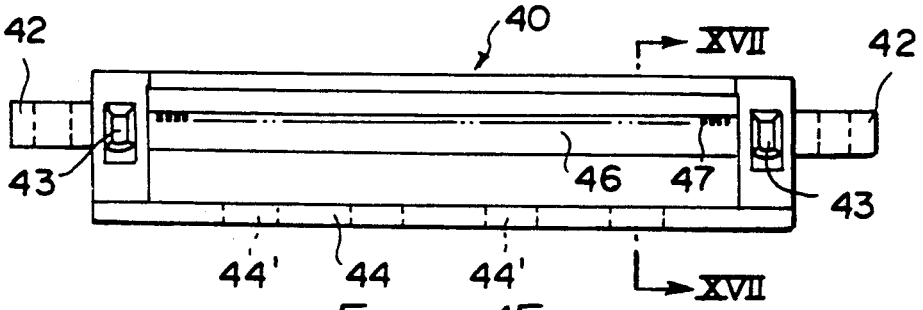
Figure 16:
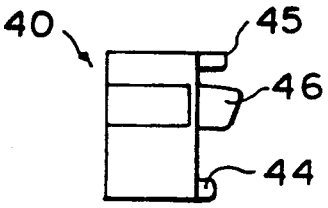
Figure 17:
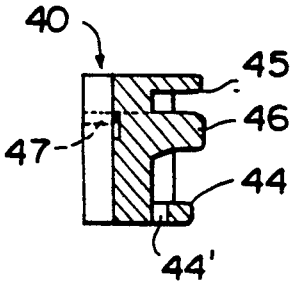
FIG. 17 is a cross-section of line XVII—XVII of FIG. 15.

FIG. 8 through FIG. 12 are detailed diagrams of the above-mentioned receptacle connector 20. FIG. 12 is a cross-section along the lines XII—XII of FIG. 10. FIG. 13 to FIG. 17 are detailed diagrams of the above-mentioned plug connector 40. FIG. 17 is a cross-section along the lines XVII—XVII of FIG. 15. The symbols used for these correspond to FIGS. 1 through 7 and there is no need to go into detail describing them.

I claim:

1. For use in mechanically and electrically interconnecting an electronic package to a computer having a body including a wall with a relief receiving the package fitted therewithin, a connector system including a first connector half having a dielectric housing and an array of contacts with the housing fixed to the body of the computer within said relief, the first connector housing further including a series of integral first projections extending across the face thereof and at right angles to such face and a recess proximate each end of the first connector housing extending into said face, a second connector half having a dielectric housing affixed to said package with said second connector half housing including a series of holes extending across a face of the housing positioned to receive the first projections of the first connector half housing with the second connector half housing further including second projections extending from the ends of such housing in a position to enter recesses of the first connector half housing with the second projections and recesses of the first and second connector half housings each having arcuate top and bottom surfaces dimensioned to provide an arcuate movement of said connectors upon insertion of said projections within said recesses to move the said package into said relief and provide a blind entry and engagement of connector halves for the mechanical and electrical mounting thereof and the package within the body of the connector.

2. The connector system of claim 1 wherein the contacts of the first half housing include spring sections defining resilient fingers and the contacts of the second half housing include flat, non-resilient contacts positioned to engage and deflect the contacts of the first half housing upon mating engagement of the connector halves.

3. The connector system of claim 1 wherein the said recesses of the first connector half housing are beveled at the entry thereof to ease entry of the second projections of the second half housing and facilitate blind mating.

4. The connector system of claim 1 wherein the said connector half housings each have lugs on the ends thereof to attach the housings to the package and components respectively.

5. The connector system of claim 1 wherein the said relief is in the bottom wall of the body of the computer to position the package and the connectors interconnecting such package to the computer beneath the body of the computer.

6. The connector system of claim 1 wherein the said computer is a portable computer and the electronic package is a disk drive.

7. An electrical connector for use in electrically connecting an electronic module to electronic equipment which includes a recessed area in which the electronic module is positioned, comprising:

a first electrical connector for electrical connection to the electronic equipment and mountable along a section of the recessed area, said first connector including a first dielectric housing having a space therealong, a plurality of first electrical contacts secured in said first housing at spaced intervals and including flexible contact sections extending into said space;

a second electrical connector for electrical connection to the electronic module and including a second dielectric housing including a projection therealong, a plurality of second electrical contacts secured in said second housing at spaced intervals corresponding to that of said first electrical contacts and having second contact sections disposed along said projection thereby rendering the second contact sections non-flexible;

projection means at spaced intervals along one of the housings intermatable with spaced holes in the other of the housings at a first position and enabling the housings to move relative to each other to a second position when the module is positioned in the recessed area whereby the projection is disposed in said space so that the second contact sections are electrically engaged with the flexible contact sections; and arcuate projections and arcuate recesses are located on the housings adjacent said projection and said space and are matable with each other when the module is positioned in the recessed area thereby guiding relative movement of the housings from the first to the second position so that the contact sections are properly engaged.

8. A separable electrical connector as claimed in claim 7, wherein said first housing includes a ledge covering said first contact sections and said second housing includes a cover member covering said second contact sections.

* * * * *